US012157609B2

(12) United States Patent
Seguin

(10) Patent No.: US 12,157,609 B2
(45) Date of Patent: Dec. 3, 2024

(54) RECEPTACLE FOR COSMETIC PRODUCT MADE OF SINGLE PLASTIC MATERIAL

(71) Applicant: ALBEA SERVICES, Gennevilliers (FR)

(72) Inventor: Franck Seguin, Gennevilliers (FR)

(73) Assignee: ALBEA SERVICES, Gennevilliers (FR)

( * ) Notice: Subject to any disclaimer, the term of this patent is extended or adjusted under 35 U.S.C. 154(b) by 0 days.

(21) Appl. No.: 17/558,318

(22) Filed: Dec. 21, 2021

(65) Prior Publication Data

US 2023/0095112 A1 Mar. 30, 2023

(30) Foreign Application Priority Data

Sep. 27, 2021 (FR) ..... 2110148

(51) Int. Cl.
*B65D 43/16* (2006.01)
*A45D 33/00* (2006.01)

(52) U.S. Cl.
CPC ..... *B65D 43/162* (2013.01); *A45D 33/003* (2013.01)

(58) Field of Classification Search
CPC .. A45D 33/22; A45D 2040/225; A45D 33/24; A45D 40/221
See application file for complete search history.

(56) References Cited

U.S. PATENT DOCUMENTS 4,681,127 A * 7/1987 Gueret ..... A45D 40/22 D28/78
4,826,014 A * 5/1989 Schefer ..... A45D 33/22 206/823
2003/0146061 A1* 8/2003 Tournier ..... E05D 11/084 188/373
2008/0099038 A1* 5/2008 Washington ..... A45D 33/008 132/300
2009/0165813 A1* 7/2009 Sekine ..... B65D 43/24 132/293
2010/0012672 A1* 1/2010 Piron ..... A45D 40/221 220/811
2012/0055503 A1* 3/2012 Kuo ..... A45D 33/006 132/293

(Continued)

FOREIGN PATENT DOCUMENTS

EP 3834655 6/2021
EP 3834655 A1 * 6/2021 ..... A45D 33/008

(Continued)

*Primary Examiner* — Ernesto A Grano
*Assistant Examiner* — Symren K Sanghera
(74) *Attorney, Agent, or Firm* — Kilpatrick Townsend & Stockton LLP

(57) ABSTRACT

A receptacle for dispensing cosmetic product includes a base adapted to receive a cup containing the product, a cover being rotatable between a position in which the receptacle is closed and a position in which the receptacle is open, connected to the base by a first hinge connection at the rear part of the receptacle, and a platform being rotatable and clamping the cup in position in the base. The receptacle also includes a structure braking the cover on opening and closing, located in the rear part of the receptacle, and a structure braking the platform on opening and closing, also located in the rear part of the receptacle.

14 Claims, 14 Drawing Sheets

(56) References Cited

U.S. PATENT DOCUMENTS

| | | | | |
|---|---|---|---|---|
| 2012/0305417 | A1* | 12/2012 | Yoshida | A45D 33/008 206/235 |
| 2012/0305442 | A1* | 12/2012 | Apodaca | A45D 33/006 220/849 |
| 2014/0061198 | A1* | 3/2014 | Seguin | B65D 53/04 220/378 |
| 2015/0320174 | A1* | 11/2015 | Kim | A47G 19/00 132/295 |
| 2018/0132595 | A1* | 5/2018 | Kang | A45D 34/00 |
| 2018/0360195 | A1* | 12/2018 | Seguin | A45D 40/221 |
| 2021/0059384 | A1* | 3/2021 | Shin | A45D 40/221 |
| 2021/0259387 | A1* | 8/2021 | Salas | A45D 33/22 |

FOREIGN PATENT DOCUMENTS

| | | |
|---|---|---|
| FR | 724260 | 4/1932 |
| FR | 2546386 | 11/1984 |
| FR | 3010286 | 3/2015 |
| FR | 3104923 | 6/2021 |
| WO | WO-9619131 | 6/1996 |

* cited by examiner

[Fig.1]
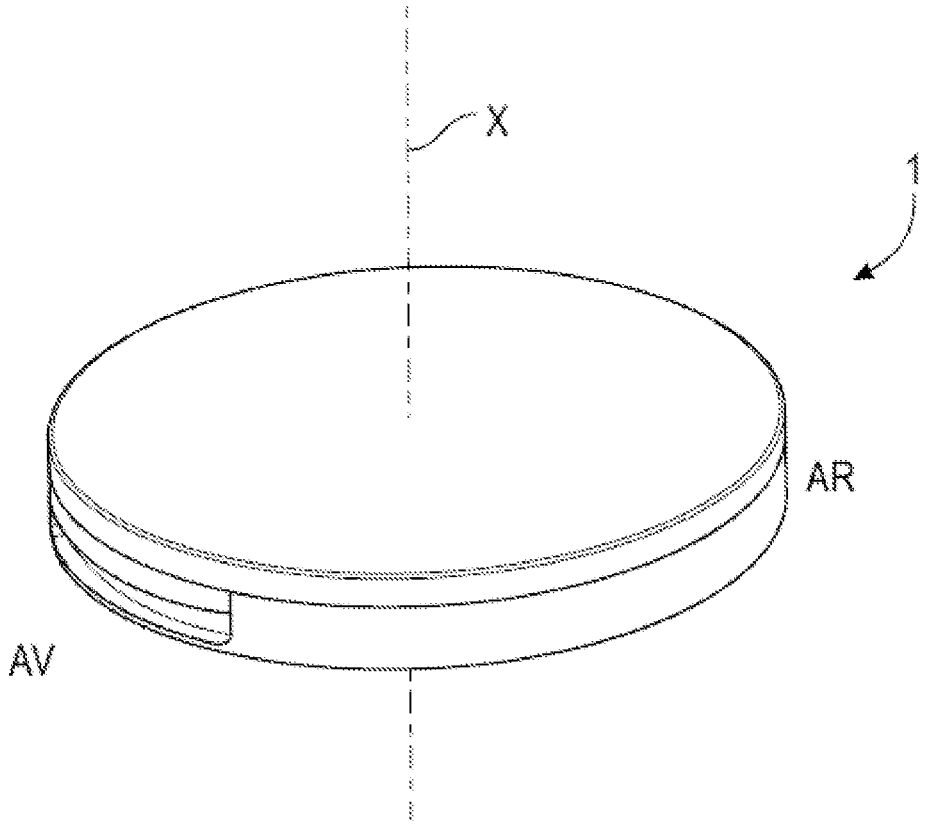
[Fig.2]
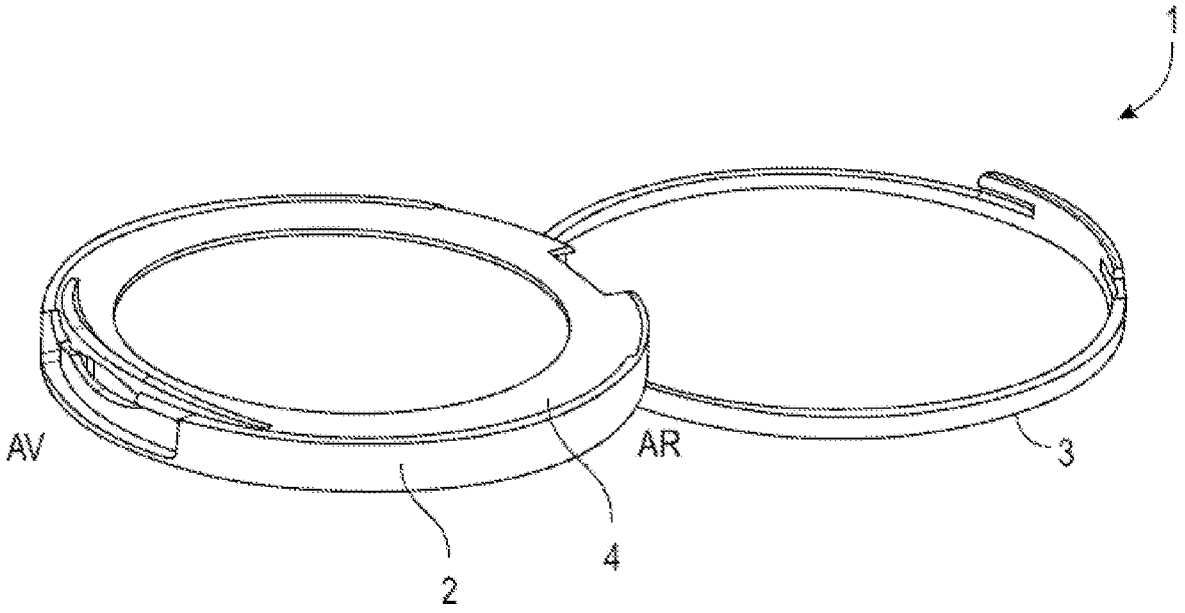

[Fig.3]
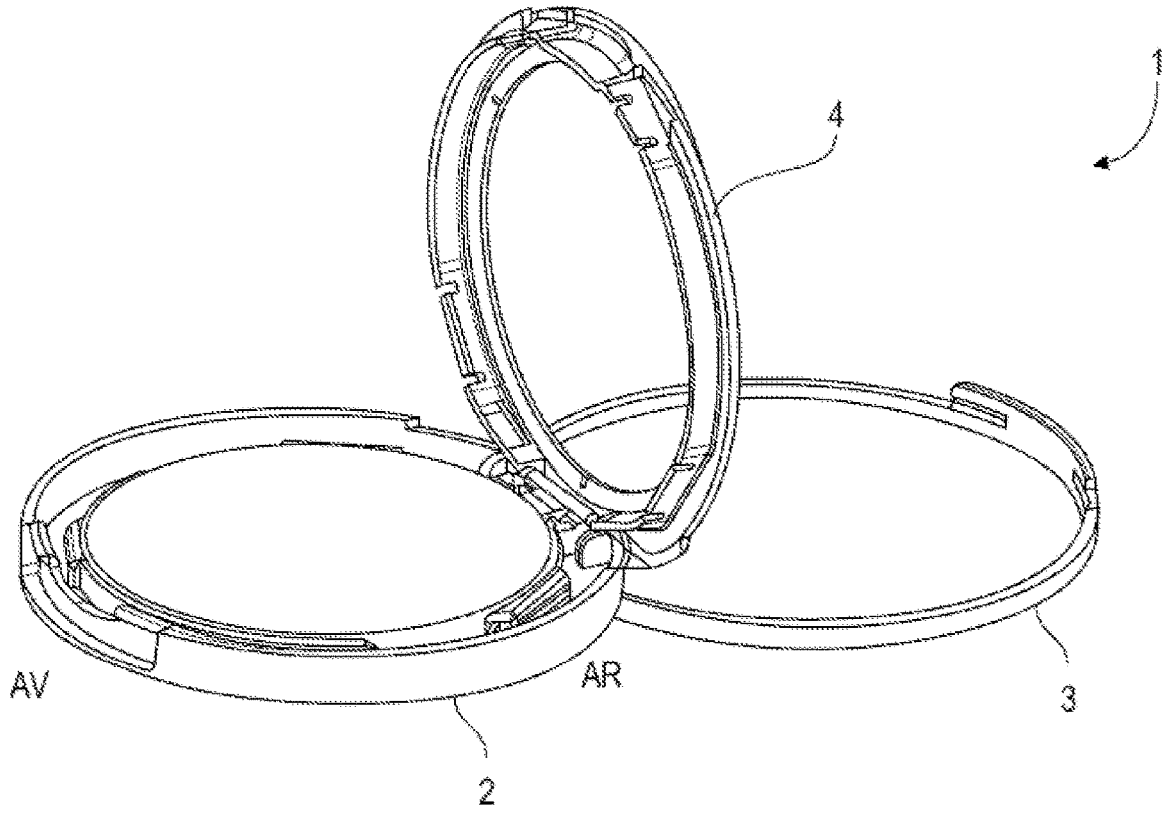
[Fig.4]
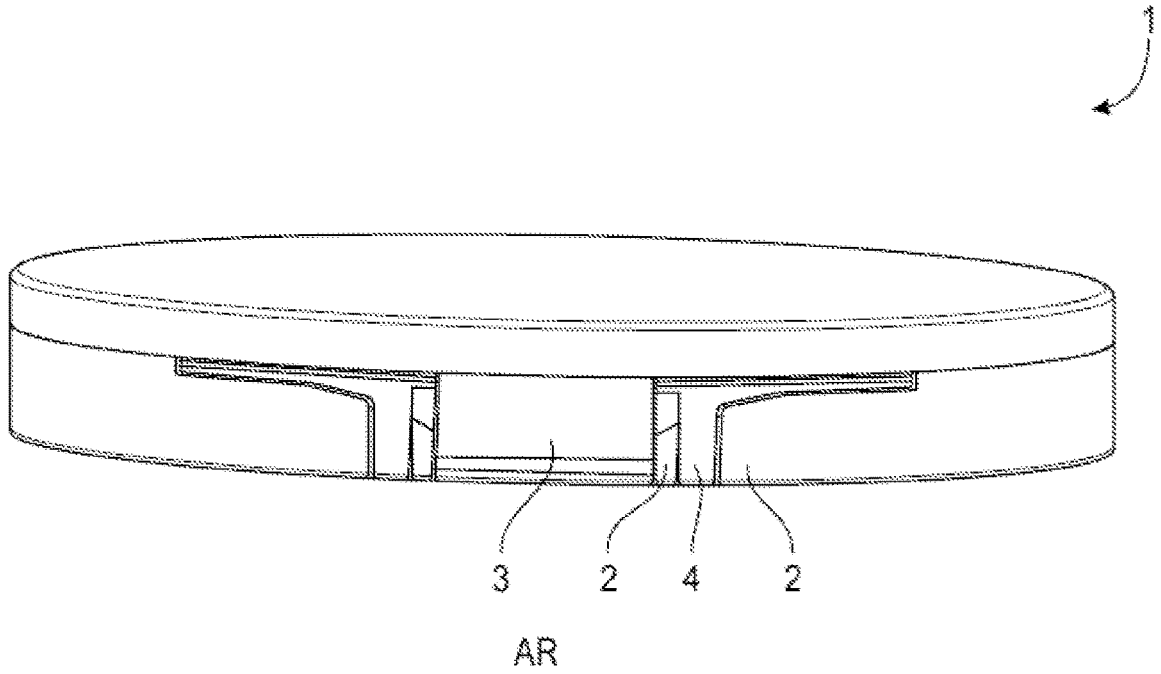

[Fig.5]
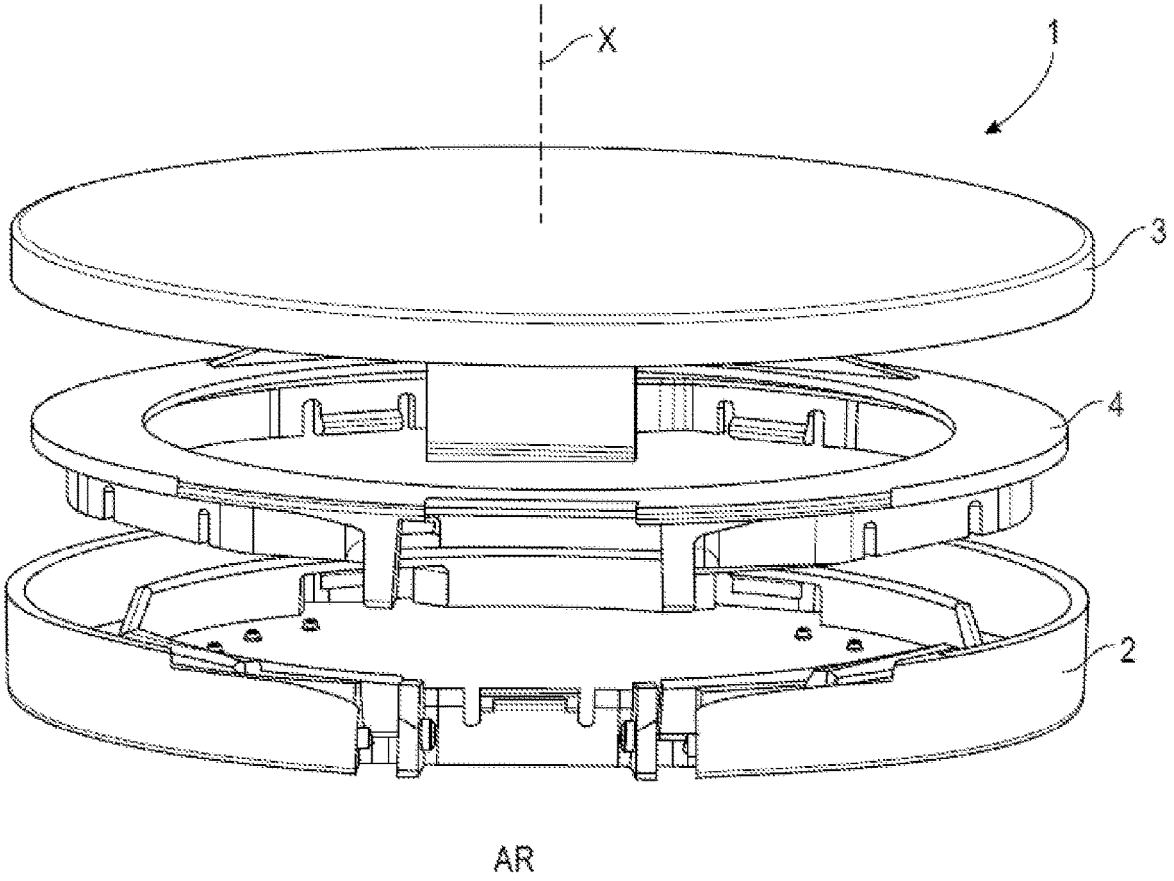

[Fig.6]
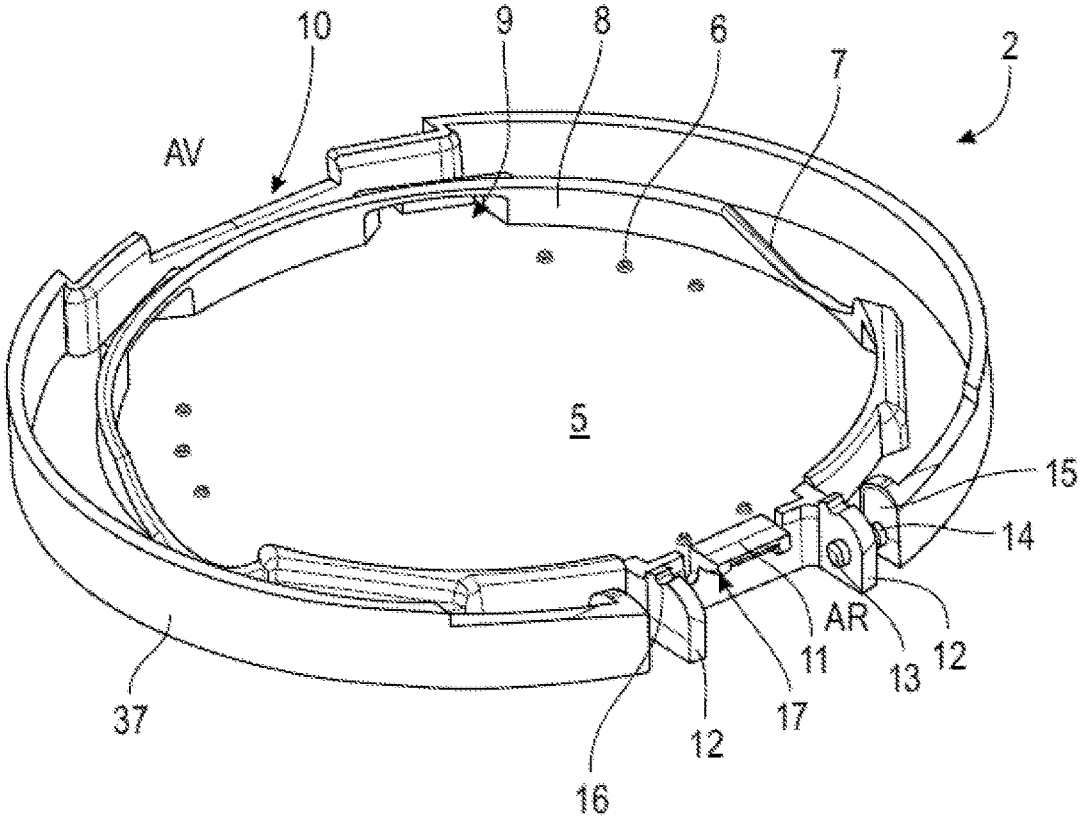
[Fig.7]
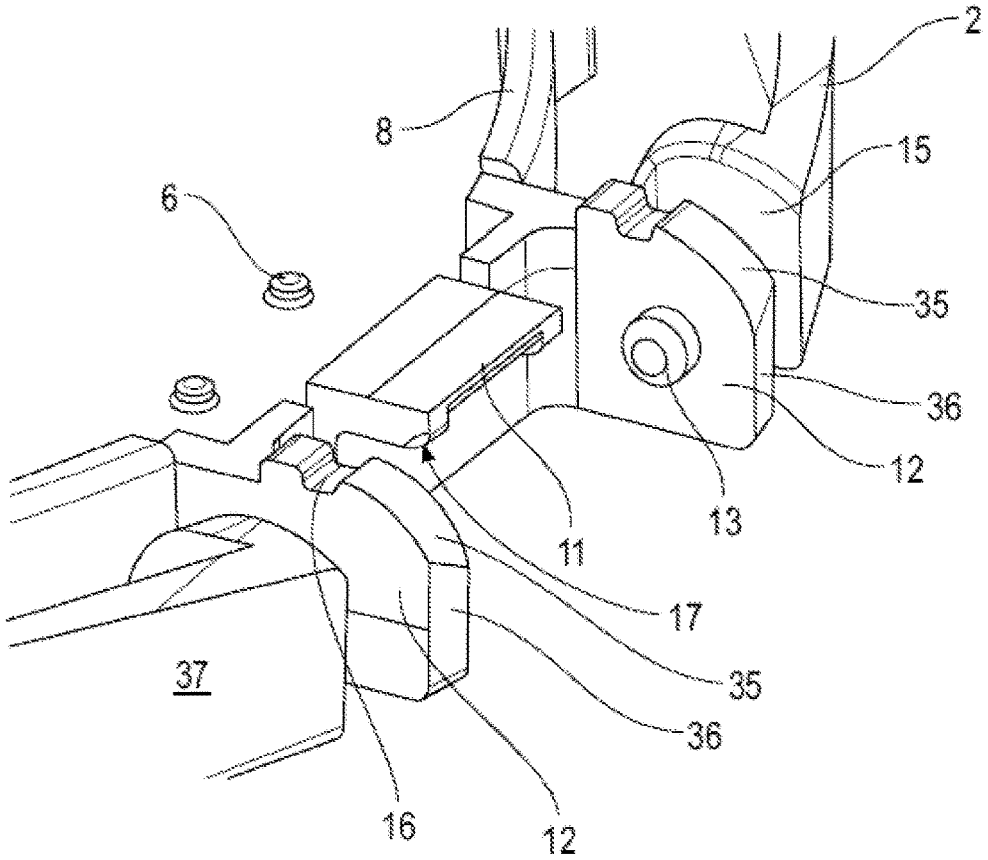

[Fig.8]
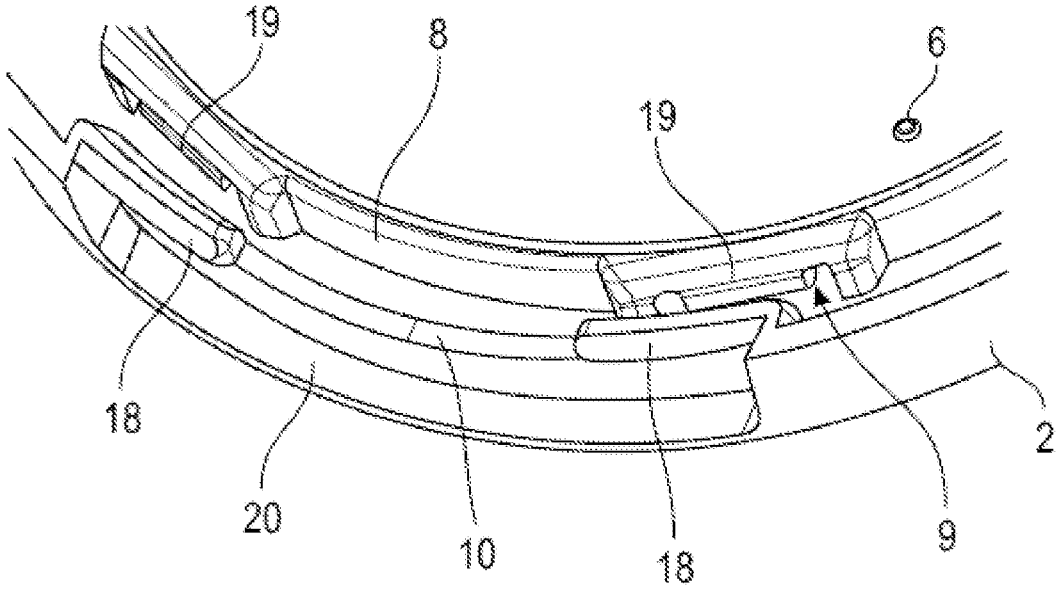

[Fig.9]
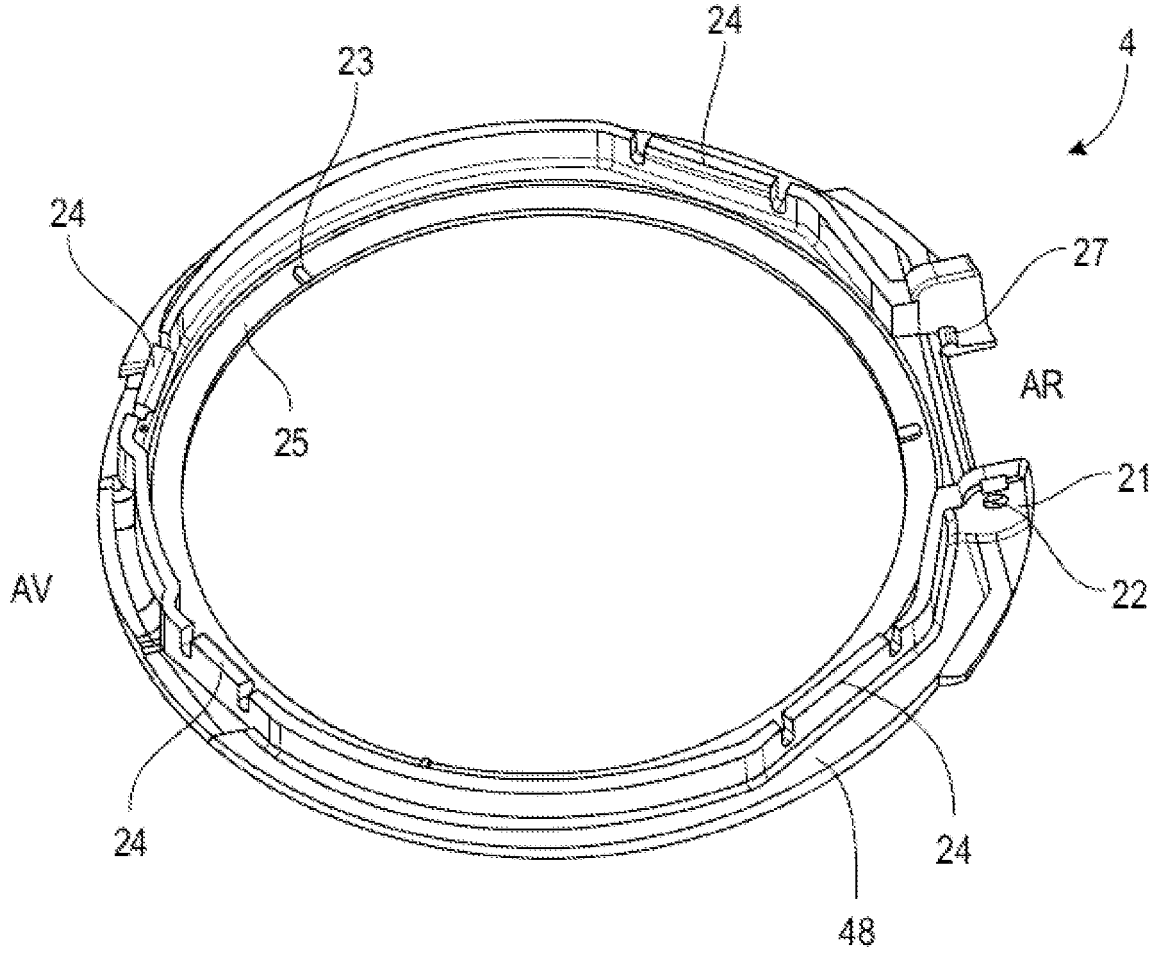
[Fig.10]
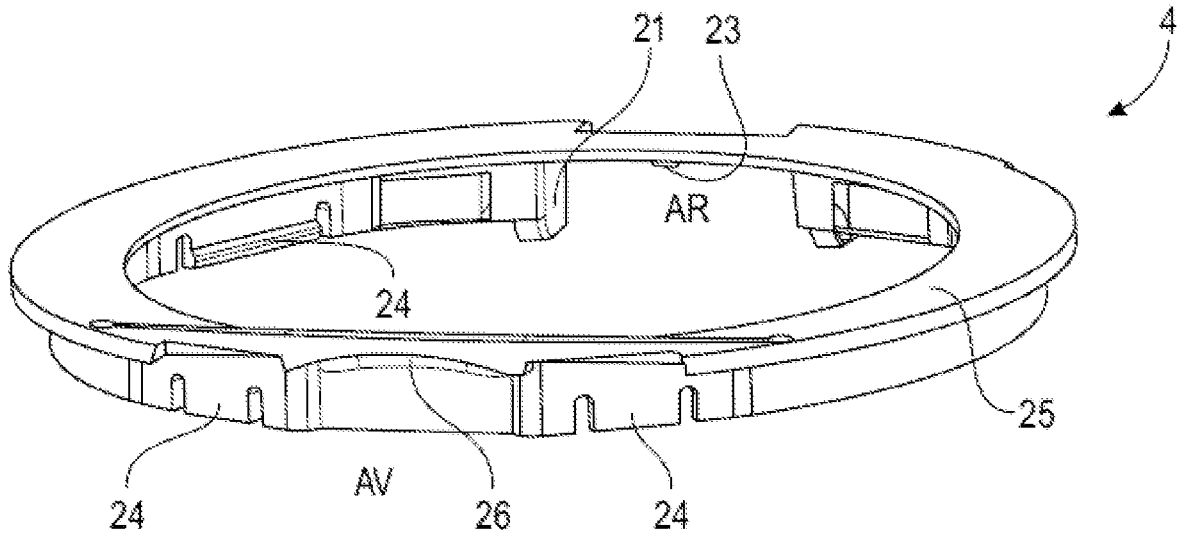

[Fig.11]
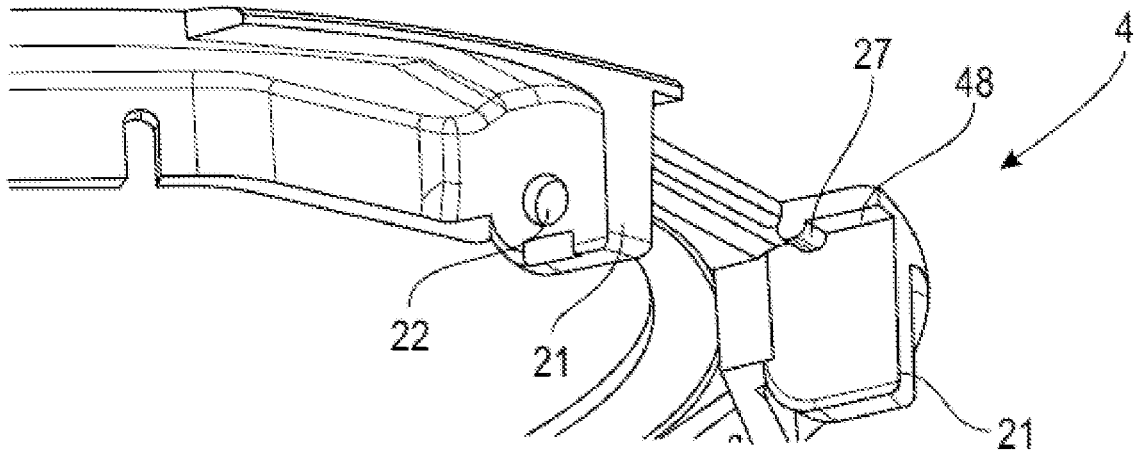

[Fig.12]
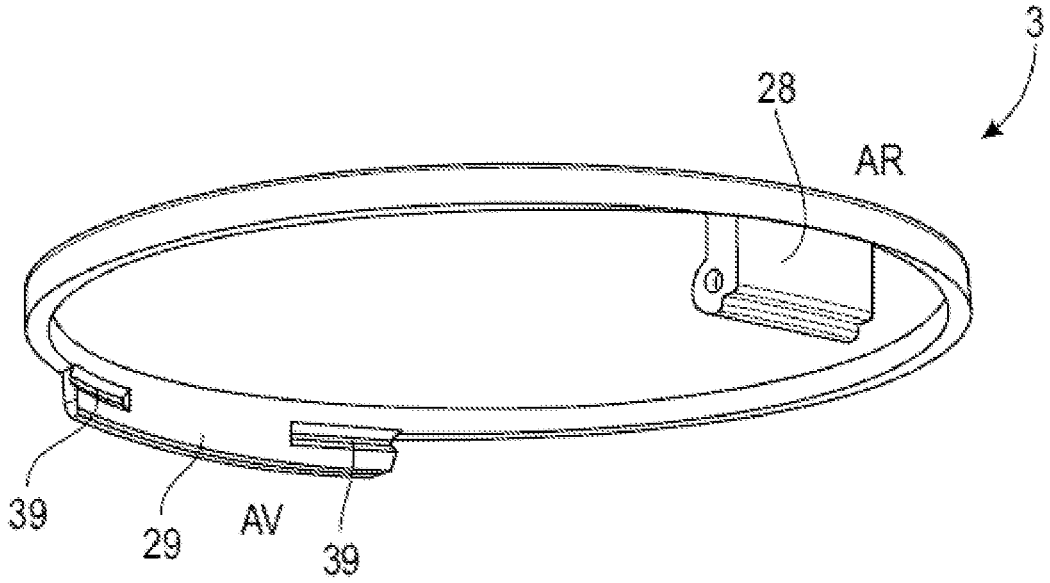
[Fig.13]
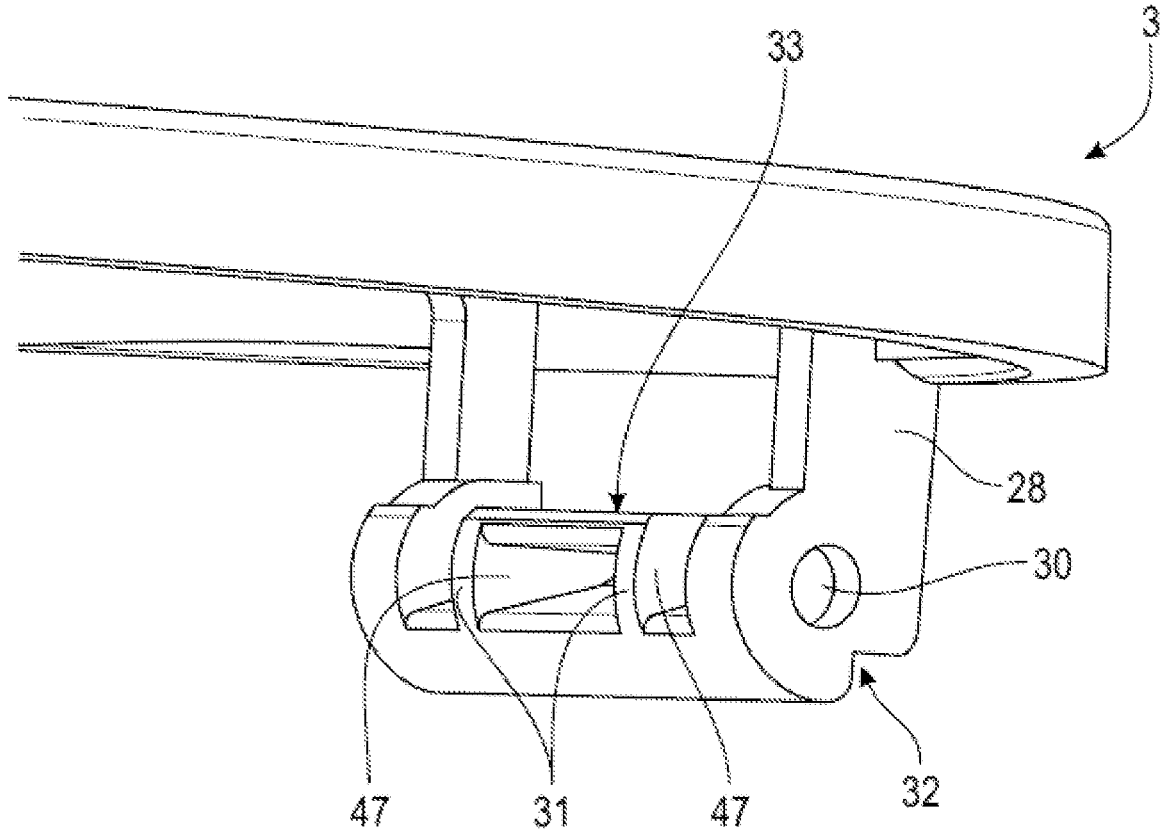

[Fig.14]
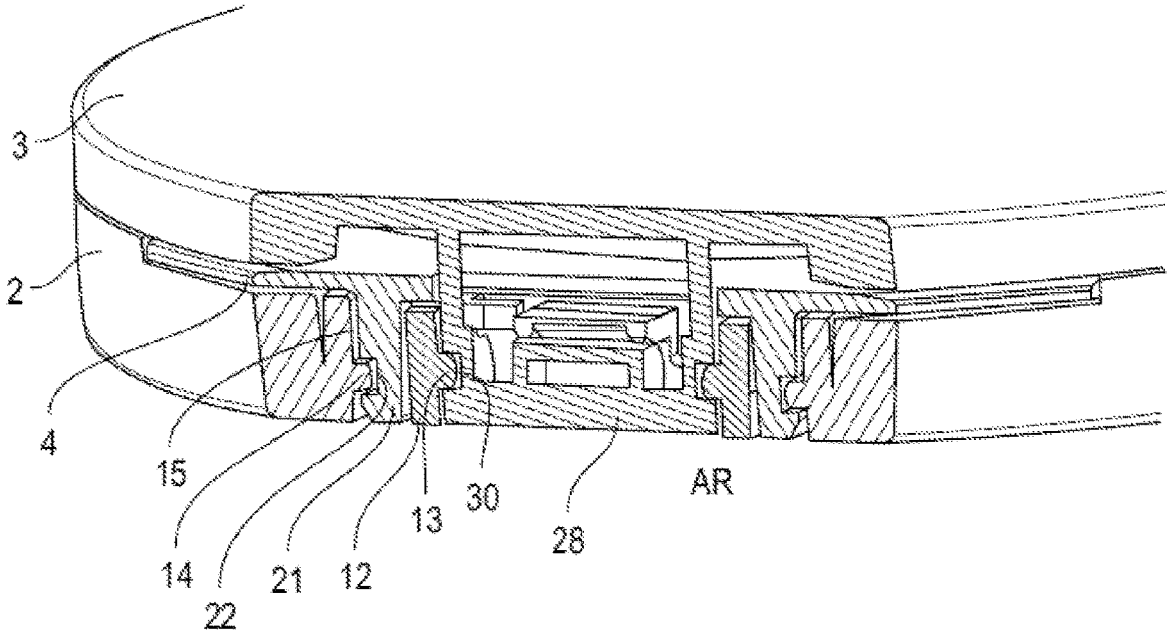
[Fig.15]
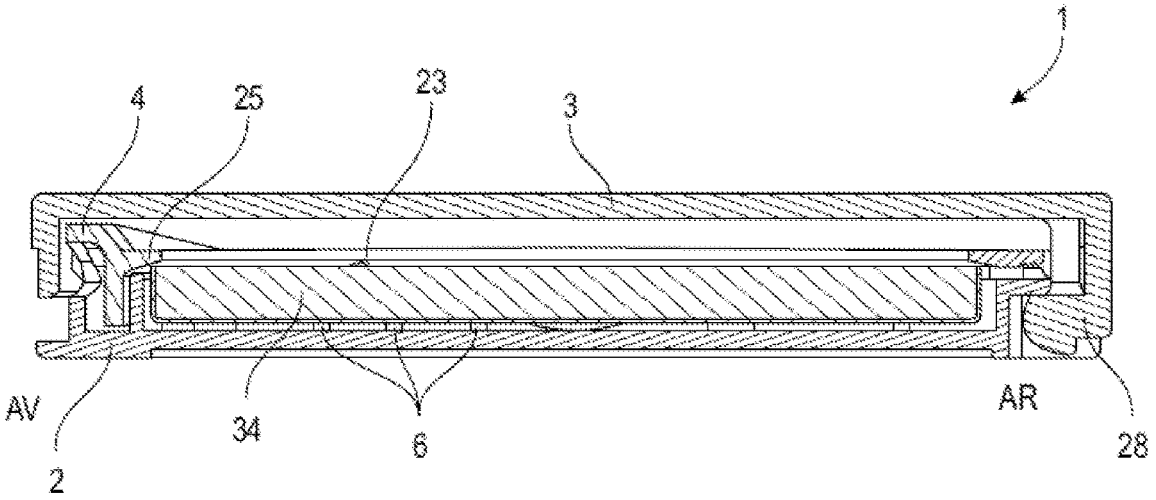

[Fig.16]
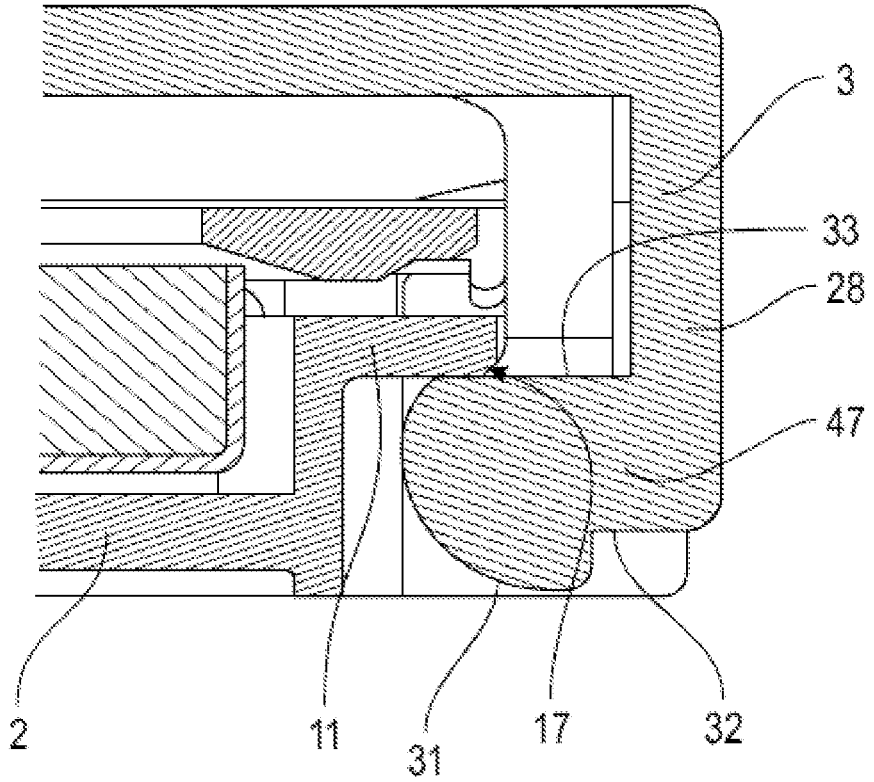
[Fig.17]
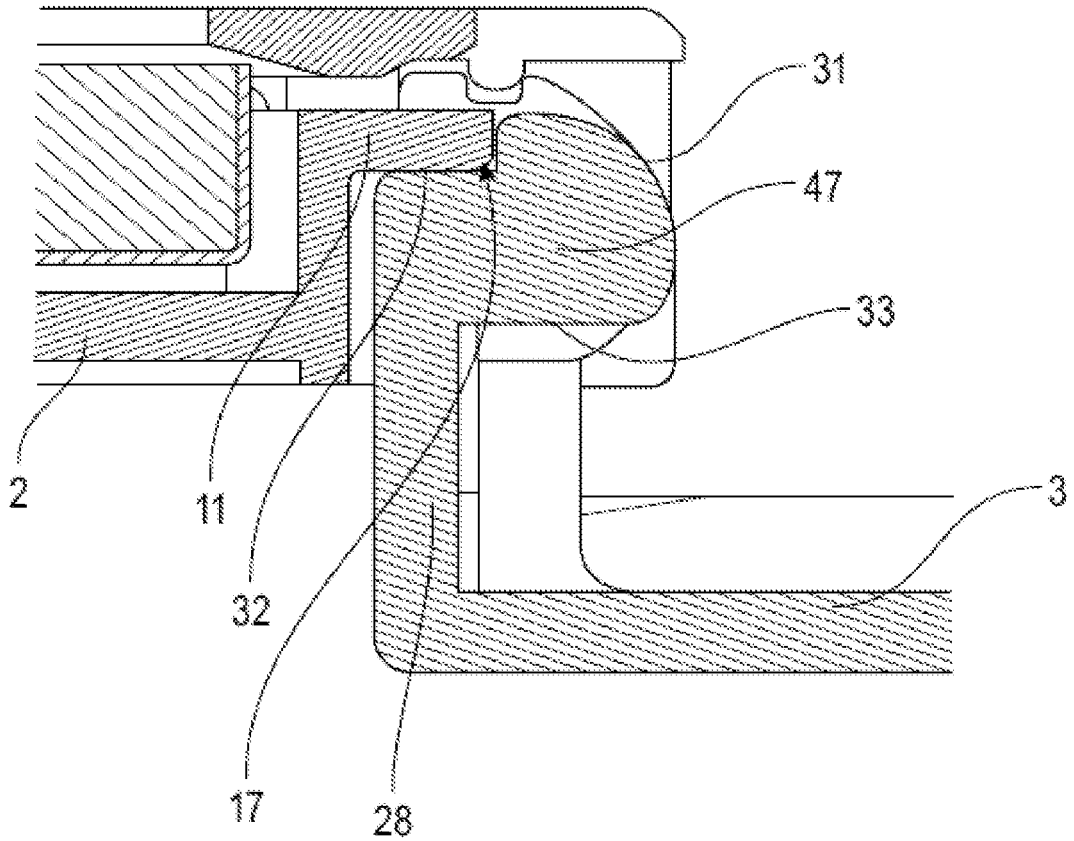

[Fig.18]
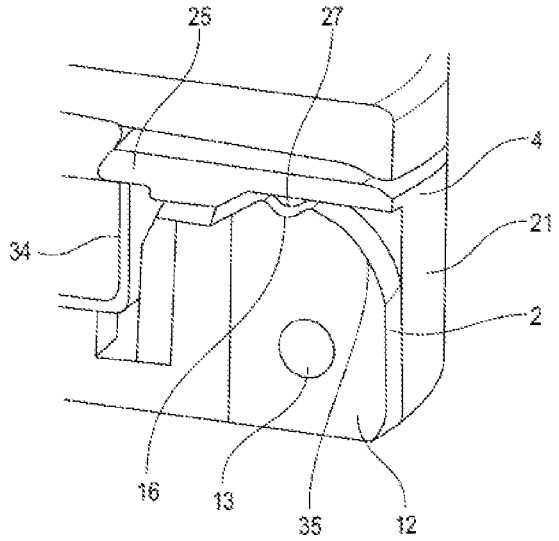
[Fig.19]
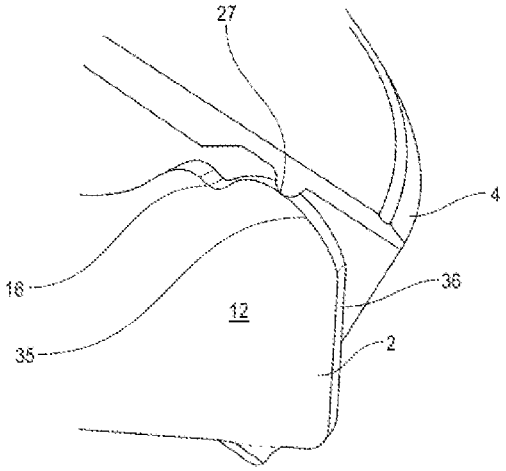
[Fig.20]
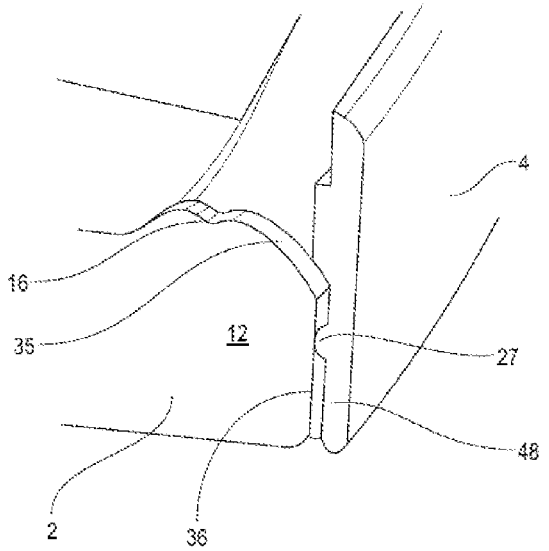

[Fig.21]
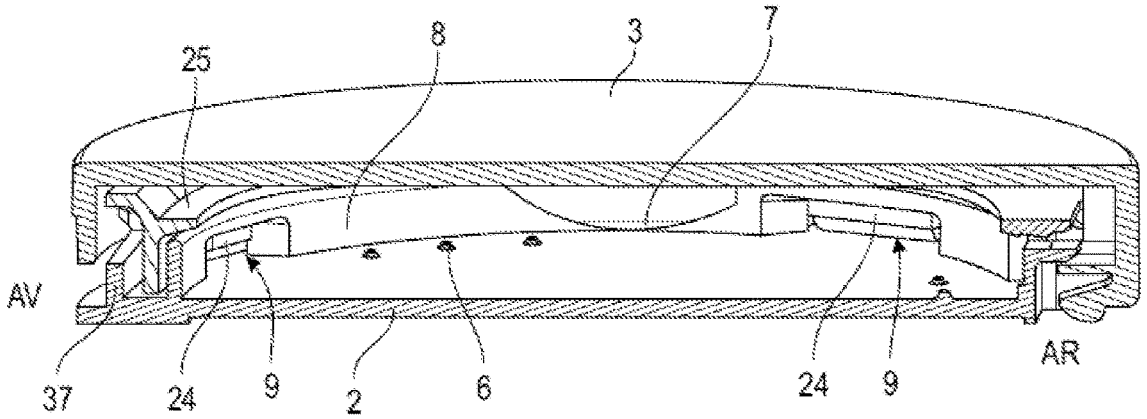
[Fig.22]
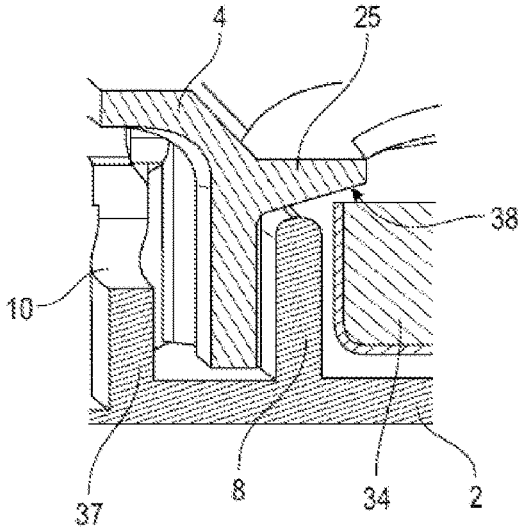
[Fig.23]
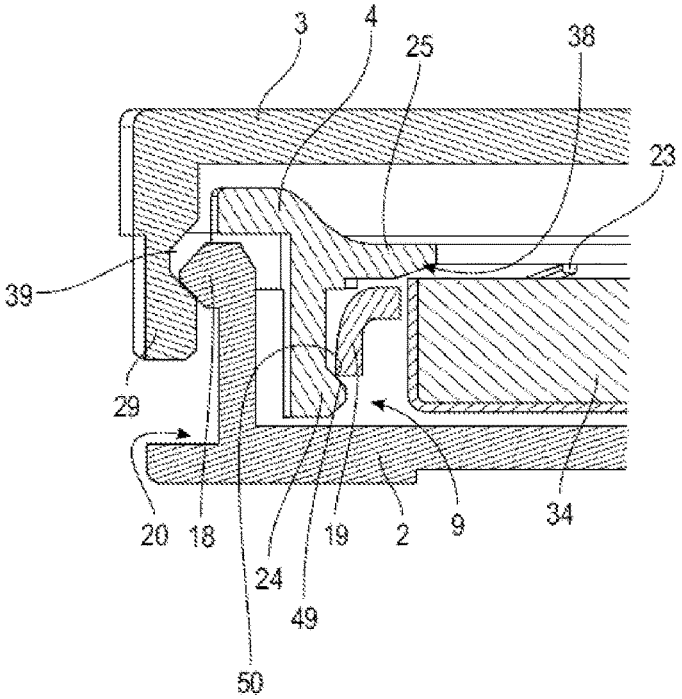

[Fig.24]
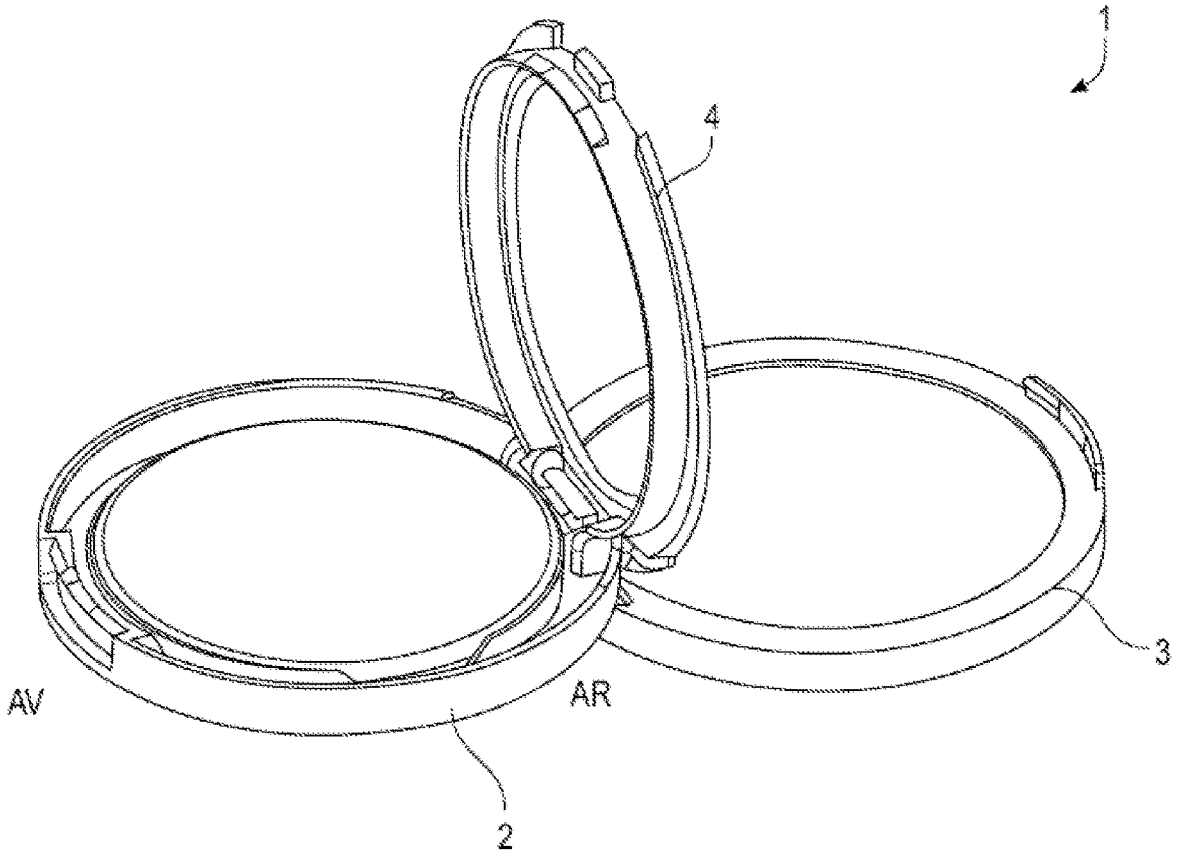
[Fig.25]
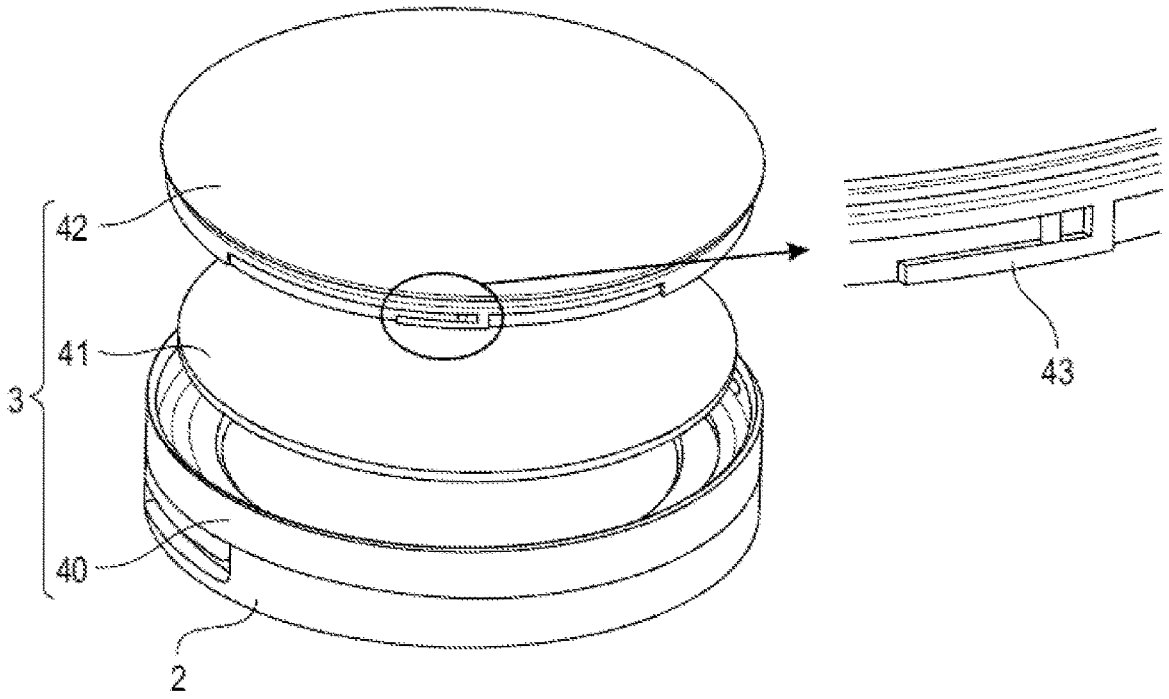

RECEPTACLE FOR COSMETIC PRODUCT MADE OF SINGLE PLASTIC MATERIAL

CROSS REFERENCE TO RELATED APPLICATIONS

This application claims priority under 35 U.S.C. § 119(a) to French patent application number 2110148, filed on Sep. 27, 2021, the entire teachings of which are incorporated herein by reference.

BACKGROUND OF THE INVENTION

Field of the Invention

The invention relates to a receptacle for dispensing a cosmetic product, such as a skincare cream or make-up powder. This receptacle is refillable with cosmetic products.

Description of the Related Art

Receptaclea for dispensing cosmetic products are known, which are generally made of plastic, and include a base connected to a cover via a hinge-like pivot connection with a metal stud. A cup filled with cosmetic product is traditionally glued to the bottom of the base, so that it does not move relative to the base when the user takes some of the product.

A mirror can also be glued to the cover so that the user can look at himself when applying make-up.

When the cover is folded back onto the base, and preferably closed by snapping, then the product contained in the cup is protected, and the receptacle is easily transportable.

When the cover is opened, the product is accessible, as well as the mirror.

One of the disadvantages of this type of receptacle is that it is not recyclable, in particular because of the presence of glue, and also because of the diversity of materials used (plastic and metal) to manufacture it.

To remedy this disadvantage, it is known to hold the cup in the base by a means other than glue, in this case by a pivoting platform interposed between the base and the cover, and bearing against the cup to hold it in position in the base. The platform has a large central window through which the product is accessible. Similarly, the mirror can be attached without glue.

It is also known to replace the metal stud with a plastic stud, in order to have the entire receptacle (excluding the cup) made of plastic, in a single material for recyclability purposes.

However, the plastic stud is more fragile and causes the cover (and the platform) to rotate freely, without constraint due to the plastic to plastic contact. Thus, the cover and the platform tend to "fall off" when opening and closing, especially in the case of a cover with a mirror, due to the weight of the mirror. Indeed, there is no brake that allows to obtain an intermediate position (i.e. between the closed position and the open position) of the cover and the platform. This braking was inherently provided by the metal stud in the prior art, due to the metal material and its friction with plastic parts, the contact between the metal and the plastic creating a constraint that allowed the cover and the platform to be positioned in multiple positions, without them "falling off".

Furthermore, the mechanical strength of the plastic stud over time is not conclusive

BRIEF SUMMARY OF THE INVENTION

The present invention aims to overcome the various disadvantages set out above, by means of a receptacle containing a removable cup, without the use of glue, and including a cover which can stably occupy several positions with different degrees of inclination according to the wishes of the user, and all this while using a single plastic material in order to allow an optimum recycling of the receptacle.

The receptacle for dispensing cosmetic product according to the invention includes, in a conventional manner:

- a base adapted to receive a cup containing the product;
- a cover being rotatable between a position in which the receptacle is closed and a position in which the receptacle is open, connected to the base by a first pivot connection at the rear part of the receptacle;
- an intermediate platform for holding the cup in position, this platform being located between the base and the cover and being rotatable between a closed position adapted to clamp the cup and an open position allowing the cup to be removed, this platform being connected to the base by a second pivot connection at the rear part of the receptacle.

This receptacle is characterized mainly in that it includes means for braking the cover on opening and closing, located in the rear part of the receptacle, and in that it also includes means for braking the platform on opening and closing, located in the rear part of the receptacle.

The main idea of this invention consists of adding means for braking the cover so that it can take multiple intermediate positions between the closed position and the open position. This allows the user to tilt the cover to its liking, which is very convenient especially when a mirror is positioned in the cover, as the mirror stays in place when the user looks at itself while applying makeup. These braking means allow to prevent the cover from falling suddenly. This braking induces a tight rotation of the cover, and no longer a free rotation.

The same applies to the platform, which is now also equipped with braking means, producing the same benefits.

The first and second pivot connections are without metal stud, so as not to mix the materials, and to allow easy recycling of the receptacle.

The pivot connections without metal stud in combination with the braking means achieve a result that is close to the holding of a metal stud with regard to the movements and the positions of the cover and the platform.

The invention also relates to an assembly including a receptacle and a cup containing the cosmetic product and being housed inside the base of the receptacle.

According to the various embodiments of the invention, which may be taken together or separately:

- the means for braking the cover are independent of the means for braking the platform.
- all the parts making up the receptacle are made of the same material.
- this material consists of plastic.
- the plastic used is PET.
- all the parts making up the receptacle are obtained by molding, by means of a plastic injection.
- the means for braking the cover consist of a first cam system inducing a constraint between two elements during the opening and the closing of the cover, and removing the constraint in open position and in closed position of the cover.

the first element of the first cam system belongs to the base and the second element belongs to the cover, the two elements being in interference during the opening and the closing of the cover, the two elements being no longer in interference in open position and in closed position of the cover.

the first element consists of at least one leg extending outwardly from the base, and the second element consists of at least one rib extending from a peripheral wall of the cover, the rib having a rounded profile along which the leg rubs when the two elements are in interference.

the means for braking the platform consist of a second cam system inducing a constraint between two elements during the opening and the closing of the platform, and removing the constraint in open position and in closed position of the platform.

the first element of the second cam system belongs to the base and the second element belongs to the platform, the two elements being in interference during the opening and the closing of the platform, the two elements being no longer in interference in open position and in closed position of the platform.

the first element consists of at least one ear extending from the base, and the second element consists of at least one wedging protrusion extending from the platform towards the base, the ear having a rounded profile along which the wedging protrusion rubs when the two elements are in interference.

the receptacle includes means for wedging the platform in closed position.

the means for wedging the platform in closed position consist of a hollow fitted in the ear and in which the wedging protrusion is housed in closed position of the platform, the hollow and the wedging protrusion having corresponding shapes.

the mounting of the platform in the base via the second pivot connection locks the assembly of the cover and the platform in the base via the first and second pivot connections.

the base has two ears arranged on either side of the leg, the ears each having a lug, the two lugs facing each other, the base also having two hanging walls arranged on either side of the two ears, the hanging walls each having a lug directed towards the adjacent ear, the cover having a hinge element with an orifice on each lateral side, this hinge element being inserted between the ears with snapping the lugs into the orifices by deformation of the ears, the platform having two hinge elements with an orifice on a lateral side opposite a hanging wall, each hinge element being inserted between an ear and a hanging wall with snapping the lugs into the orifices by a force fit, locking the first and second pivot connections of the receptacle.

the cover includes a peripheral body and a removable upper wafer locked to the peripheral body by a bayonet-type system, the cover also including a mirror held between an internal rim of the peripheral body and internal flexible legs of the upper wafer.

the receptacle includes a positioning system of the cup to limit any relative movement of the cup with respect to the base.

this positioning system includes an inclined bearing surface of the platform resting against an upper rim of the cup.

this positioning system cooperates with a hanging system provided between the platform and the base in order to prevent the platform from being shifted and badly locked on the base. This ensures that the platform can be reliably closed. This also prevents too much pressure when the platform is closed.

the positioning system includes a plurality of pins projecting from a bottom of the base and on which the cup rests, the pins being rigid.

the inclined bearing surface flares radially outwardly.

the inclined bearing surface has clamping lugs projecting towards the cup and bearing against the upper rim of the cup.

two clamping lugs are arranged on either side of the front part of the receptacle, and a clamping lug is arranged at the rear part of the receptacle.

the receptacle has a flexible geometry between the base and the platform.

the hanging system consists of a snapping cooperation between flexible legs provided on the platform and windows provided on the base.

the base has an inner skirt sized to surround and laterally contain the cup, the inner skirt having a plurality of windows into which fit the flexible legs provided for this purpose on the platform.

each leg has an inclined wall in sliding contact with a slice of the window after snapping, allowing to maintain a clearance in the closing of the platform according to the tightening of the cup.

the receptacle includes a hook-type closure system between the cover and the base.

the front tab of the base is delimited by the two protrusions.

the platform has a tab for gripping the platform, the tab being rounded towards the top of the receptacle and located opposite the front tab of the base.

the base has two lateral tabs for gripping the cup, the lateral tabs being made in an internal skirt in the central part of the base Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein:

FIG. 1 is a general perspective view of the closed receptacle according to the invention;

FIG. 2 is a general perspective view of the open receptacle according to the invention;

FIG. 3 is a general perspective view of the open receptacle with the platform also open;

FIG. 4 is a general perspective view of the rear part of the closed receptacle;

FIG. 5 is an exploded perspective view of the rear part of the receptacle;

FIG. 6 is a perspective view of the base of the receptacle;

FIG. 7 is a perspective view showing the detail of the rear part of the base;

FIG. 8 is a perspective view showing the detail of the front part of the base;

FIG. 9 is a perspective view showing the underside of the platform of the receptacle;

FIG. 10 is a perspective view of the platform;

FIG. 11 is a perspective view showing the detail of the rear part of the platform;

FIG. 12 is a perspective view of the cover of the receptacle;

FIG. 13 is a perspective view showing the rear part of the cover;

FIG. 14 is a perspective and cross-sectional view of the two pivot connections located at the rear part of the closed receptacle;

FIG. 15 is a cross-sectional view of the closed receptacle;

FIG. 16 is a cross-sectional view of the closed receptacle at the level of the means for braking the cover;

FIG. 17 is a cross-sectional view of the open receptacle at the level of the means for braking the cover;

FIG. 18 is a cross-sectional view of the closed receptacle at the level of the means for braking the platform, with the platform in closed position;

FIG. 19 is a cross-sectional view of the open receptacle at the level of the means for braking the platform, with the platform in intermediate position;

FIG. 20 is a cross-sectional view of the open receptacle at the level of the means for braking the platform, with the platform in open position;

FIG. 21 is a cross-sectional and perspective view of the closed receptacle without cup;

FIG. 22 is a cross-sectional and perspective view showing the detail of the positioning system in the vicinity of the front tab of the base;

FIG. 23 is a cross-sectional and perspective view showing the detail of the centering clamping system in the vicinity of the hooking system between the base and the cover in the front part of the receptacle;

FIG. 24 is a general perspective view of the open receptacle with a variant of the cover;

FIG. 25 is an exploded view of the receptacle with the variant of the cover;

DETAILED DESCRIPTION OF THE INVENTION

Figure 26:
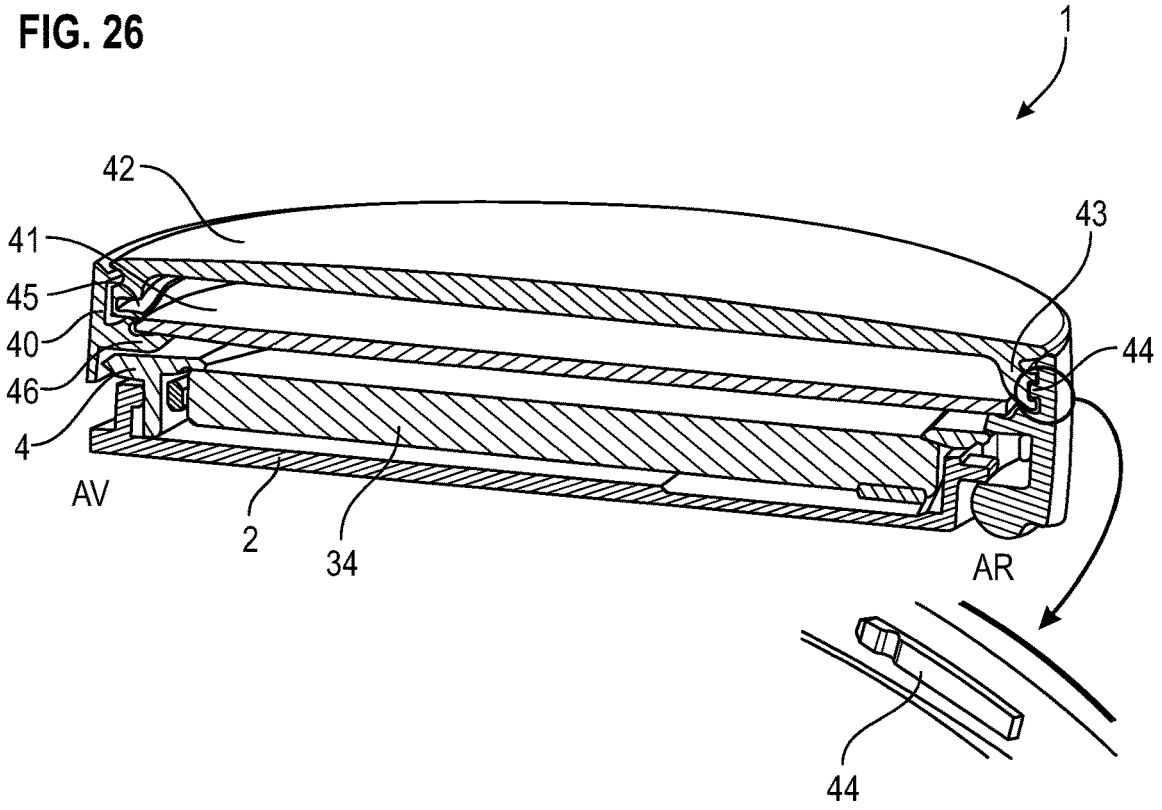
FIG. 26 is a cross-sectional and perspective view of the closed receptacle with the variant of the cover.

In the following description, elements with identical structure or similar functions will be designated by same references.

By convention, the "axial" direction corresponds to the main extension of the receptacle, illustrated by the axis X in FIG. 1, and the "radial" direction is orthogonal to the axial direction.

In the following detailed description of the figures, the terms "upper" and "lower" or "top" and "bottom" will be used without limitation in reference to the axial direction. Thus, the term "upper" refers to a part located in the vicinity of a cover of the receptacle, and the term "lower" refers to a part located in the vicinity of a bottom of the receptacle.

Similarly, the terms "outer or external" and "inner or internal" are used with reference to the radial direction, an outer element being radially further from the axis X than an inner element.

FIG. 1 shows the receptacle 1 in closed position.

This is a receptacle 1 particularly adapted for containing make-up products of the compacted make-up powder type. This cosmetic product is contained in a cup 34 located inside the receptacle 1.

This receptacle 1 is cylindrical.

This receptacle 1 traditionally consists of a base 2 to which a cover 3 is connected via a first pivot connection.

The pivot connection is located at the rear part AR of the receptacle 1, while the front part AV of the receptacle 1, located opposite the rear part, has a clasp.

This cover 3 is movable between a closed position as shown in FIG. 1 and an open position as shown in FIG. 2 where the cosmetic product is then accessible.

In this FIG. 2, the cover 3 is open at 180-∞.

A platform 4 for holding the cup 34 in position is visible here in closed position on the base 2. The cup 34 is interposed between the base 2 and the platform 4.

The platform 4 has a central window through which it is possible to perceive the cosmetic product contained in the cup 34.

The cup 34 may have any shape, and any particular technical area. In the illustrated figures, the cup 34 is cylindrical.

The cup 34 is made of treated steel or aluminum. Any other material may be considered within the scope of the present invention.

The platform 4 is connected to the base 2 via a second pivot connection, as can be seen in FIG. 3. Indeed, the platform 4 is pivoting between a closed position as in FIG. 2, where the cup 34 is held in position regardless of the position of the cover 3, and an open position as in FIG. 3, where the cup 34 is released, allowing the user to have access to the cup 34, in particular if he wishes to replace it.

The second pivot connection is also located at the rear part of the receptacle 1, like the first pivot connection.

FIG. 4 shows the rear part of the receptacle 1, with the two pivot connections.

In FIG. 5, the rear part of the receptacle 1 is still visible, in particular the rear part of the base 2, of the platform 4 and of the cover 3, allowing the various hinge connections to be seen more precisely.

FIGS. 6 to 8 show the base 2 of the receptacle 1.

The platform 4 is illustrated in FIGS. 9 to 11. It has an annular shape, with the large central window allowing free access to the cup 34 once everything is in place in the receptacle 1.

The cover 3 is shown in FIGS. 12 and 13.

This base 2 is open at the upper part. It includes a bottom 5 and a peripheral wall 37. It also includes an inner skirt 8 defining a housing for housing the cup 34. This skirt 8 thus allows to contain the cup 34 laterally.

In this inner skirt 8, there are two side tabs 7 allowing the user to hold the cup 34 when inserting it into the housing, and also when removing it from the housing, when the user wishes to replace the cup 34 with another.

In the rear part of the base 2, there are several elements belonging to the first pivot connection and to the second pivot connection. These elements will be detailed later in the description.

At the rear part of the base 2, there is also a part of the means for braking the cover 3 during opening and closing.

The other part of the means for braking the cover 3 is located at the rear part of the cover 3, as illustrated in particular in FIGS. 12 and 13.

More precisely, these means for braking the cover 3 consist of a first cam system inducing a constraint between two elements during the opening and the closing of the cover 3, and removing the constraint in open and closed position of the cover 3.

The first element of the first cam system belongs to the base 2, and consists of a leg 11 directed towards the outside of the receptacle 1. This leg 11 extends orthogonally to the axis X.

This leg 11 is located exactly in the middle of the rear part of the base 2.

The second element of the first cam system belongs to the cover 3 and consists of at least one rib 47 extending from a peripheral wall of the cover 3.

More specifically, this rib 47 is located on a hinge element 28 extending from the peripheral wall of the cover 3.

This rib 47 has a particular profile, in particular a first area 33 which is flat, followed by a second area 31 which is rounded, followed by a third area 32 which corresponds to an undercut.

The leg 11 of the base 2 has a contact wall, with a chamfer 17 in the vicinity of its free end, adapted to slide on the profile of the rib 47.

As can be seen in FIGS. 15 and 16, when the cover 3 is closed, the leg 11 rests freely on the first flat area 33 of the rib 47. In this position, there is no force exerted between the leg 11 and the rib 47. There is no constraints.

As the user begins to lift the cover 3, the leg 11 begins to slide along the second rounded area 31 of the rib 47. This sliding is done with sufficient friction to create a constraint between the base 2 and the cover 3, so that the opening of the cover 3 is done with a certain restraint, i.e. with a braking in the opening movement and in the closing movement of the cover 3. Thus, as soon as the user stops his opening or closing effort, the cover 3 remains in the position as it is, and does not tend to fall back to its closed position or its open position.

Thus, the user can choose the desired inclination of the cover 3, and the latter is in position thanks to the constraint existing between the leg 11 and the rounded profile of the rib 47.

When the user fully opens the cover 3, i.e., when it is rotated 180-∞, as shown in FIG. 17, then the leg 11 is in the third area 32 of the rib 47, in this case in the undercut. In this position, there is no force exerted between the leg 11 and the rib 47. There is no longer any constraint.

According to the configuration shown, the hinge element 28 of the cover 3 has two ribs 47 along which two contact surfaces provided on a same leg 11 of the base 2 rub.

These means for braking the cover 3 on opening and closing are very practical so that the user can incline the cover as he wishes, without it falling back, especially as the first pivot connection is made between two plastic parts and therefore induces a more fluid and easier pivoting than between a plastic part and a metal part (for example a metal stud), due to the differences in friction coefficients.

A similar principle is used for the braking of the platform 4 during its handling.

Indeed, the receptacle 1 includes means for braking the platform 4 on opening and closing, located in the rear part of the receptacle 1.

These means for braking the platform 4 are independent of the means for braking the cover 3. Indeed, they have no common elements, and they are not implemented simultaneously.

These means for braking the platform 4 consist of a second cam system inducing a constraint between two elements during the opening and the closing of the platform 4, and removing the constraint in open position and closed position of the platform 4.

The first element of the second cam system belongs to the base 2 and the second element belongs to the platform 4, the two elements being in interference during the opening and the closing of the platform 4, the two elements being no longer in interference in open position and closed position of the platform 4.

The first element of the second cam system consists of at least one ear 12 extending from the base 2, as is well illustrated in FIG. 7. This ear 12 has a particular profile, in particular a first area with a hollow 16, followed by a second rounded area 35, followed by a third area 36 corresponding to a flat undercut.

The second element of the second cam system consists of at least one wedging protrusion 27 extending from the platform 4 towards the base 2.

More precisely, as is clearly visible in FIGS. 9 and 11, the platform 4 includes, at the rear part, an external rim 48 from which the wedging protrusion 27 projects.

The wedging protrusion 27 is adapted to slide over the profile of the ear 12.

As can be seen in FIG. 18, when the platform 4 is closed, the wedging protrusion 27 rests freely on the first area, and more precisely in the hollow 16 provided for this purpose. In this position, the platform 4 is perfectly aligned with the base 2. There is therefore no risk of it being slightly shifted forwards or backwards, it is perfectly centered on the base 2. The hollow 16 and the wedging protrusion 27 have corresponding shapes so that there is no clearance and the wedging is optimal. In this position, there is no force exerted between the wedging protrusion 27 and the hollow 16. There is no constraints.

As the user begins to lift the platform 4, the wedging protrusion 27 begins to slide along the second rounded area 35 of the ear 12, as shown in FIG. 19. This sliding is done with sufficient friction to create a constraint between the base 2 and the platform 4, so that the opening of the platform 4 is done with a certain restraint, i.e. a braking in the opening movement and in the closing movement of the platform 4. Thus, as soon as the user stops his opening or closing effort, the platform 4 remains in the position as it is, and does not tend to fall back to its closed position or open position.

Thus, the user can choose the desired inclination of the platform 4, and the latter is in position due to the constraint between the wedging protrusion 27 and the rounded profile 35 of the ear 12.

When the user fully opens the platform 4, i.e., when the platform is rotated 90-∞, as shown in FIG. 20, then the wedging protrusion 27 is in the third area 36 of the ear 12, in this case in the undercut. In this position, there is no force exerted between the wedging protrusion 27 and the ear 12. There is no longer any constraint. It can be seen that there is an offset between the rim 48 of the platform 4, and the third area 36 of the ear 12, this offset corresponding at least to the thickness of the wedging protrusion 27. Thus, there is no longer any support of the wedging protrusion 27 against the ear 12.

According to the configuration presented, the base 2 has two parallel ears 12 arranged on either side of the rear part of the leg 11, and the platform 4 has two wedging protrusions 27 which cooperate with these two ears 12.

These means for braking the platform on opening and closing are very practical so that the user can incline the platform as he wishes, without it falling back, especially as the second pivot connection is made between two plastic parts and therefore induces a smoother and easier pivoting than between a plastic part and a metal part (e.g. a metal stud), due to the differences in friction coefficients.

In particular, the present invention focuses on a receptacle 1 that can be fully recyclable. This requires that all the parts that make up the receptacle 1 be made of the same material, so that the consumer can throw the receptacle 1 in a single bin, and does not have to disassemble the parts to sort them into different recycling bins.

For recyclability purposes, it is understood that the cup 34 is removable, and must be removed prior to throw the receptacle 1.

Thus, the base 2, the cover 3 and the platform 4 are all made of the same plastic material.

The plastic material may be selected from polypropylene (PP), recycled polypropylene (R-PP), polyethylene terephthalate (PET), recycled polyethylene terephthalate (R-PET), thermoplastic elastomer (TPE), polyethylene (PE), such as the low density polyethylene (LDPE) and/or the high density polyethylene (HDPE), composite material, post-consumer recycled material (PCR and/or similar material).

Preferably, it is polypropylene and/or polyethylene terephthalate, whether recycled or not.

Thus, advantageously, all the parts, namely the base, the platform and the cover are made of plastic material selected from polypropylene and/or polyethylene terephthalate.

In addition, the use of plastic materials, in particular similar plastic materials, for the entire receptacle allows to facilitate the recycling. In particular, the polypropylene (PP) and the polyethylene terephthalate (PET) are two plastic materials whose recycling cycle is well known.

The receptacle can be made in 3D printing.

The base 2, the cover 3 and the platform 4 can be obtained by molding, by means of a plastic injection.

Alternatively, the base, the cover and the platform can be made in 3D printing. Such a printing method allows in particular to produce these parts with particular patterns and shapes very freely.

In this case, since there are no longer any metal studs in the receptacle according to the invention, the 3D printing is all the easier.

In the receptacle 1 according to the invention, there are no metal studs. The pivot connections are created directly in the base 2, the cover 3 and the platform 4, without any additional parts. This allows to make it easier to recycle the receptacle (1).

We will now describe the two pivot connections present on the receptacle 1 according to the invention.

These two pivot connections are of the hinge type.

The first pivot connection allows to connect the cover 3 to the base 2.

The hinge element 28 of the cover 3 has two lateral sides, each lateral side having a central orifice 30.

The two ears 12 of the base 2 each have a lug 13, the two lugs 13 facing each other.

Thus, when the hinge element 28 of the cover 3 is inserted between the two ears 12 of the base 2 when mounting the cover 3 in the base 2, the lugs 13 of the base 2 penetrate into the orifices 30 of the cover 3, causing the cover 3 to snap into the base 2. During this insertion, the two ears 12 deform slightly outwards to allow the hinge element 28 to be wedged between the two lugs 13, until the lugs 13 penetrate the orifices 30.

This snapping is in particular visible in FIG. 14.

Thus, there are no metal studs in this first hinge.

The second pivot connection allows to connect the platform 4 to the base 2.

As illustrated in FIG. 7, the base 2 has two hanging walls 15 arranged on either side of the two ears 12, and at a distance from the two ears 12. Indeed, a small space is provided between these hanging walls 15 and the ears 12. These hanging walls 15 constitute a termination of the peripheral wall 37 of the base 2.

These hanging walls 15 are oriented perpendicular to the peripheral wall 37. Each hanging wall 15 has a lug 14 directed towards the adjacent ear 12.

As shown in FIG. 11, the platform 4 includes two hinge elements 21, also resembling ears. Each hinge element 21 of the platform 4 is adapted to be inserted into the free space located between a hanging wall 15 and the adjacent ear 12 of the base 2.

Each hinge element 21 has an orifice 22 on a lateral side opposite the corresponding hanging wall 15.

Thus, when the two hinge elements 21 of the platform 4 are inserted between the ears 12 and the hanging walls 15 of the base 2 during the assembly of the platform 4 in the base 2, the lugs 14 of the hanging wall 15 of the base 2 penetrate into the orifices 22 of the hinge elements 21 of the platform 4, causing the platform 4 to snap into the base 2.

The platform 4 is mounted on the base 2 after the cover 3 has been mounted.

Thus, when the platform 4 is mounted, the ears 12 can no longer be deformed inwardly, as the hinge element 28 of the base 2 blocks. The insertion of the platform 4 into the base 2 must therefore be done by force.

There is an independence between the first hinge and the second hinge.

In fact, the first hinge consists of the ears 12 of the base 2 and the hinge element 28 of the cover 3, while the second hinge consists of the hinge elements 21 of the platform 4 and the hanging walls 15 of the base 2.

There is no connection between the hanging walls 15 and the ears 12 of the base 2. Moreover, the facing walls between the ear 12 and the hinge element 21 are flat, and are not connected.

Thus, the pivoting of the cover 3 does not induce any constraint on the pivoting of the platform 4, and vice versa. This allows to obtain two pivot connections with an optimum quality, without the need for metal studs.

When the platform 4 is mounted in the base 2, the two pivot connections of the receptacle 1 are locked, as they prevent any deformation of the ears 12, since the space between the ears 12 and the hanging walls 15 is now occupied by the hinge elements 21 of the platform 4.

The disassembly of the cover 3 of the platform 4 is therefore no longer possible, without risk of breaking the components. This locking is important as there are no longer any metal studs to ensure this function.

The receptacle 1 according to the invention includes a positioning system of the cup 34 to limit any relative movement of the cup 34 with respect to the base 2. These means allow to compensate for any dimensional variations of the cup, and to ensure an optimal positioning of the cup within the base, so that the clamping is then performed uniformly around the entire circumference of the cup, and to ensure the integrity of the cup and of the product contained therein.

This positioning system is carried by the base 2 and the platform 4, and cooperates with a hooking system provided between the platform 4 and the base 2 in the front part of the receptacle 1.

This cooperation allows to prevent the platform from being shifted and poorly locked to the base. This allows to ensure that the platform is securely closed and cannot be opened accidentally when handling and transporting the receptacle. This also allows to prevent too much pressure when the platform is closed. The different systems are linked, and work in synergy to achieve the objective.

The positioning system consists of:

a plurality of pins 6 projecting from the bottom 5 of the base 2 and on which the cup 34 rests. These pins 6 are rigid and not flexible. These pins 6 allow the cup 34 to be positioned and wedged in height in the base 2.

an inclined bearing surface 25 of the platform 4 resting against an upper rim of the cup 34 to center it. This inclined bearing surface 25 flares radially outwards. This is particularly apparent in the cross-sectional views of FIGS. 21 and 22. It can be seen that the bearing surface has an inclined lower face 38 (due to the frustoconical shape) which comes into contact with the upper rim of the cup 34. This inclined lower face 38 forms a ramp along which the contact can be made with the cup 34, depending on the dimensions of the cup 34. Since this ramp extends around the entire circumference of the cup 34, it directly causes the cup 34 to be centered within the housing of the base 2. This bearing surface can be frustoconical or spherical, or similar to a chamfer.

The cup 34 is thus wedged between the rigid pins 6 and this inclined bearing surface 25, in a centered manner, thus limiting any rotation of the cup 34 within the base 2 during the handling of the receptacle 1 and during the withdrawal of cosmetic product. In particular, the rigid pins 6 act as means for blocking the cup 34 against rotation.

Furthermore, these pins 6 allow the blocking of the cup 34 to be functional even if the cosmetic powder comes under the cup 34, which would not be the case if the cup rested directly on the bottom of the receptacle, as it could slide on the powder.

In order to compensate the dimensional variations of the cup 34, once it is centered, it is necessary to provide a flexibility between the base 2 and the platform 4. Thus, a flexible geometry is provided to absorb the dimensional variations of the cup 34.

This flexible geometry is made possible thanks to a hooking system consisting of a snapping cooperation between flexible legs 24 provided on the platform 4 and windows 9 provided on the base 2.

In the present case, as illustrated in FIG. 21, the inner skirt 8 of the base 2, which is dimensioned to surround and laterally contain the cup 34, has windows 9 into which flexible legs 24 provided for this purpose on the platform 4 are inserted.

Once the legs 24 are inserted into the windows 9, the platform 4 remains flexible in relation to the base 2. Indeed, the legs 24 have an inclined wall 49 along which the contact with the upper slice 50 of a frame 19 of the window 9 can be made, as illustrated in FIG. 23, where the cross-section is performed at the level of a window 9/leg 24 assembly. Thus the platform 4 can descend more or less inside the base 2, depending on the height of the cup 34 to be clamped and centered.

This flexibility allows to avoid over-tightening the cup 34, and thus allows to avoid cracking the powder contained therein.

In order to ensure an optimum clamping of the cup 34, in particular in the event of a change in height along the peripheral wall of the cup 34, clamping lugs 23 are provided which project from the inclined bearing surface 25 towards the cup 34.

Such a lug 23 can be seen in FIG. 23 for example. These lugs 23 are very small and allow small dimensional variations to be compensated for in order to ensure an optimum clamping. The clamping lugs 23 come to rest against the upper rim of the cup 34, and the platform 4 can be deformed slightly. As can be seen in FIG. 9, there are two clamping lugs 23 arranged on either side of the front part of the receptacle 1, and one clamping lug 23 arranged at the rear part of the receptacle 1.

The positioning system and the hooking system also cooperate optimally thanks to the wedging of the platform 4 in closed position in the base 2, via the wedging protrusion 27 which is housed in the hollow 16, as previously explained.

A closing system is provided between the cover 3 and the base 2 at the front part of the receptacle 1.

This locking system consists of hooks. For example, at least one protrusion 18 provided at the front of the base 2 is adapted to snap into at least one groove 39 provided for this purpose at the front of the cover 3. The reverse could be considered, i.e. a protrusion in the cover, and a groove in the base.

FIG. 23 shows this snapping between the protrusion 18 and the groove 39.

It can be seen that the protrusion 18 has an inclined wall in sliding contact with another inclined wall of the groove 39 after snapping. This sliding contact allows to maintain a clearance, or a flexibility, in the closing of the cover 3.

The sinking of the cover 3 into the base 2 is independent of the clamping of the cup 34 by the platform 4.

In the configuration shown, there are two protrusions 18 provided at the front of the base 2, as illustrated in FIG. 8, and adapted to snap into two grooves 39 provided for this purpose in a closing element 29 at the front of the cover 3, as illustrated in FIG. 12.

The receptacle 1 has a window 9/flexible leg 24 assembly opposite each protrusion 18/groove 39 assembly.

In order to be able to properly lift the cover 3, the base 2 has, at the front part, a hollow 20 in which the closing element 29 of the cover 3 is housed, while leaving the low part of the recess 20 free. The user can insert his finger into the low part of the recess 20 to be able to easily lift the cover 3 by pulling the closure element 29.

In order to be able to correctly lift the platform 4, the base 2 has, at the front part, a front tab 10 rounded towards the bottom 5 of the receptacle 1, above which is positioned another tab 26 rounded towards the top of the receptacle 1, provided at the front part of the platform 4. These two tabs 10, 26 allow to create a space within which the user can insert its finger to easily lift the platform 4 by pulling on the tab 26 of the platform 4.

In the configuration shown here, in FIG. 8, it can be seen that the front tab 10 of the base 2 is located between the two protrusions 18 of the hooking system.

In the receptacle 1 shown in FIGS. 1 to 23, the cover 3 simply consists of an upper disc accompanied by a peripheral wall.

Alternatively, a variant of the cover 3 as shown in FIGS. 24 to 27 may be used.

In this variant of cover 3, the description of the cover 3 remains the same excepting that the cover 3 is thicker as it incorporates a mirror 41.

The cover 3 includes a peripheral body 40 as well as a removable upper wafer 42 locked to the peripheral body 40 by a bayonet-type system. The mirror 41 is interposed between an internal rim 46 of the peripheral body 40 and the wafer 42.

Even more specifically, the mirror 41 is held between the internal rim 46 of the peripheral body 40 and internal flexible legs 45 provided on the wafer 42.

Figure 27:
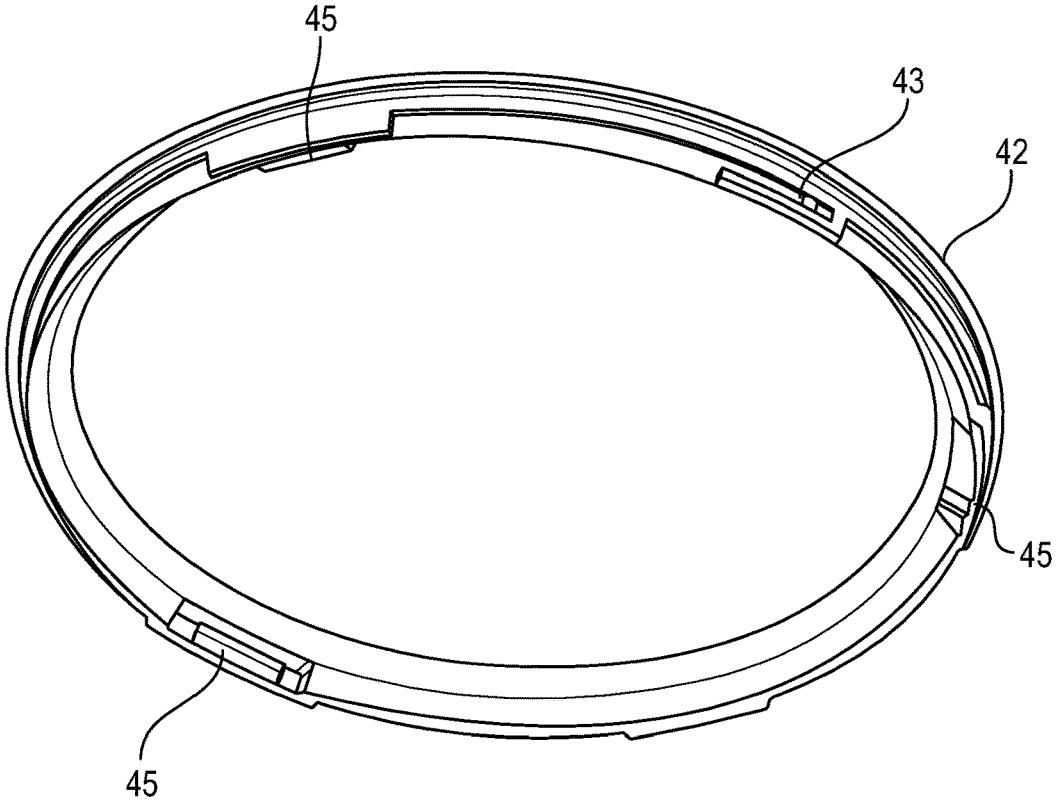
FIG. 27 is a perspective view of the wafer belonging to the variant of the cover.

These internal flexible legs 45 are illustrated in particular in FIG. 27, and are three in number, evenly distributed around the periphery of the wafer 42.

In the bayonet-type system, the peripheral body 40 includes a plurality of lamellae 44 adapted to penetrate into grooves 43 provided for this purpose in the periphery of the wafer 42. Preferably, there are three assemblies of lamella 44/grooves 43.

In order to ensure the locking between the wafer 42 and the peripheral body 40, a conventional hard point system is put in place, so that the lamella 44 is locked in position in the groove 43 once the hard point has been passed, following a rotational movement of the wafer 42 with respect to the body 40.

Other systems for locking the wafer 42 to the peripheral body 40 may be contemplated within the scope of the present invention.

The embodiments shown in the cited figures are only possible examples, in no way limiting, of the invention which, on the contrary, encompasses the variations of shapes and designs within the reach of the person skilled in the art.

Of note, the terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "includes", and/or "including," when used in this specification, specify the presence of stated features, integers, steps, operations, elements, and/or components, but do not preclude the presence or addition of one or more other features, integers, steps, operations, elements, components, and/or groups thereof.

As well, the corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

Having thus described the invention of the present application in detail and by reference to embodiments thereof, it will be apparent that modifications and variations are possible without departing from the scope of the invention defined in the appended claims as follows.

The invention claimed is:

1. A receptacle for dispensing a cosmetic product comprising:

a base adapted to receive a cup containing a cosmetic product;

a cover being rotatable between a position in which the receptacle is closed and a position in which the receptacle is open, connected to the base by a first pivot connection at a rear part of the receptacle;

an intermediate platform for holding the cup in position, this platform being located between the base and the cover and being rotatable between a closed position adapted to clamp the cup and an open position allowing the cup to be removed, this platform being connected to the base by a second pivot connection at the rear part of the receptacle;

means for braking the cover on opening and closing, located in the rear part of the receptacle, and consisting of a first cam system, a first element of the first cam system belonging to the base and a second element of the first cam system belonging to the cover, the first element of the first cam system and second element of the first cam system being in interference during the opening and the closing of the cover, wherein said first element of the first cam system extends outwardly from a middle of the rear part of the base, and the second element of the first cam system extends from a peripheral wall of the cover; and means for braking the platform on opening and closing, located in the rear part of the receptacle, and consisting of a second cam system, a first element of the second cam system belonging to the base and a second element of the second cam system belonging to the platform, the first element of the second cam system and second element of the second cam system being in interference during the opening and the closing of the platform, wherein said first element of the second cam system extends from the base and is arranged on either side of the first element of the first cam system, and the second element of the second cam system extends from the platform towards the base;

wherein said first cam system is independent of said second cam system.

2. The receptacle according to claim 1, wherein the first and second pivot connections are without metal studs.

3. The receptacle according to claim 1, wherein the receptacle is composed of the base, the cover and the platform, said base, said cover and said platform being made of the same material.

4. The receptacle according to claim 3, wherein the material consists of plastic.

5. The receptacle according to claim 4, wherein the plastic used is PET.

6. The receptacle according to claim 1, wherein the first element of the first cam system and the second element of the first cam system are no longer in interference in open position and in closed position of the cover.

7. The receptacle according to claim 6, wherein said first element of the first cam system consists of at least one leg extending outwardly from the base, and the second element of the first cam system consists of at least one rib extending from a peripheral wall of the cover, said rib having a rounded profile along which the leg rubs when the first element of the first cam system and the second element of the first cam system are in interference.

8. The receptacle according to claim 1, wherein the first element of the second cam system and the second element of the second cam system are no longer in interference in open position and in closed position of the platform.

9. The receptacle according to claim 8, wherein said first element of the second cam system consists of at least one ear extending from the base, and the second element of the second cam system consists of at least one wedging protrusion extending from the platform towards the base, said ear having a rounded profile along which the wedging protrusion rubs when the first element of the second cam system and the second element of the second cam system are in interference.

10. The receptacle according to claim 1, wherein the receptacle comprises means for wedging the platform in closed position.

11. The receptacle according to claim 10 wherein a first element of the second cam system consists of at least one ear extending from the base, and a second element of the second cam system consists of at least one wedging protrusion extending from the platform towards the base, said ear having a rounded profile along which the wedging protrusion rubs when the first element of the second cam system and the second element of the second cam system are in interference, and wherein said means for wedging the platform in closed position consist of a hollow fitted in said ear and in which the wedging protrusion is housed in closed position of the platform, the hollow and the wedging protrusion having corresponding shapes.

12. An assembly comprising a receptacle comprising:

a cup containing a cosmetic product and being housed inside a base of a receptacle, the receptacle comprising:

a cover being rotatable between a position in which the receptacle is closed and a position in which the receptacle is open, connected to the base by a first pivot connection at a rear part of the receptacle;

an intermediate platform for holding the cup in position, this platform being located between the base and the cover and being rotatable between a closed position adapted to clamp the cup and an open position allowing the cup to be removed, this platform being connected to the base by a second pivot connection at the rear part of the receptacle;

means for braking the cover on opening and closing, located in the rear part of the receptacle, and consisting of a first cam system, a first element of the first cam system belonging to the base and a second element of the first cam system belonging to the cover, the first element of the first cam system and second element of the first cam system being in interference during the opening and the closing of the cover, wherein said first element of the first cam system extends outwardly from a middle of the rear part of the base, and the second element of the first cam system extends from a peripheral wall of the cover; and means for braking the platform on opening and closing, located in the rear part of the receptacle, and consisting of a second cam system, a first element of the second cam system belonging to the base and a second element of the second cam system belonging to the platform, the first element of the second cam system and the second element of the second cam system being in interference during the opening and the closing of the platform, wherein said first element of the second cam system extends from the base and is arranged on either side of the first element of the first cam system, and the second element of the second cam system extends from the platform towards the base;

wherein said first cam system is independent of said second cam system.

13. A receptacle for dispensing a cosmetic product comprising:

a base adapted to receive a cup containing a cosmetic product;

a cover being rotatable between a position in which the receptacle is closed and a position in which the receptacle is open, connected to the base by a first pivot connection at a rear part of the receptacle;

an intermediate platform for holding the cup in position, this platform being located between the base and the cover and being rotatable between a closed position adapted to clamp the cup and an open position allowing the cup to be removed, this platform being connected to the base by a second pivot connection at the rear part of the receptacle;

means for braking the cover on opening and closing, located in the rear part of the receptacle, and consisting of a first cam system, a first element of the first cam system belonging to the base and a second element of the first cam system belonging to the cover, the first element of the first cam system and second element of the first cam system being in interference during the opening and the closing of the cover; and means for braking the platform on opening and closing, located in the rear part of the receptacle, and consisting of a second cam system, a first element of the second cam system belonging to the base and a second element of the second cam system belonging to the platform, the first element of the second cam system and the second element of the second cam system being in interference during the opening and the closing of the platform;

wherein the location of the first element of the first cam system and the second element of the first cam system is different from the location of the first element of the second cam system and second element of the second cam system, and wherein said first cam system is independent of said second cam system.

14. The receptacle of claim 1, wherein the cover and the platform are parallel to one another and are both non-collinear relative to a horizontal plane.

* * * * *